United States Patent [19]

Moore

[11] 4,191,299

[45] Mar. 4, 1980

[54] PARTITION WITH RESILIENT TONGUES FOR ENGAGING PERFORATED SHELVING

[75] Inventor: David M. Moore, Pittsburgh, Pa.

[73] Assignee: Armstrong Store Fixture Corporation, Pittsburgh, Pa.

[21] Appl. No.: 885,667

[22] Filed: Mar. 13, 1978

[51] Int. Cl.[2] ..... A47F 5/00

[52] U.S. Cl. ..... 211/184; 108/61

[58] Field of Search ..... 211/184, 43; 108/60, 108/61

[56] References Cited

U.S. PATENT DOCUMENTS

| | | | |
|---|---|---|---|
| 1,758,307 | 5/1930 | Bales | 211/184 UX |
| 2,516,122 | 7/1950 | Hughes | 211/184 |
| 2,601,201 | 6/1952 | Bales | 108/60 |
| 2,658,628 | 11/1953 | Hilgen | 211/184 |
| 3,872,976 | 3/1975 | Moore et al. | 211/184 |
| 3,954,184 | 5/1976 | Mendenhall | 211/184 |

FOREIGN PATENT DOCUMENTS

| | | | |
|---|---|---|---|
| 1362684 | 4/1964 | France | 211/184 |

*Primary Examiner*—Ramon S. Britts
*Assistant Examiner*—Robert W. Gibson, Jr.
*Attorney, Agent, or Firm*—Parmelee, Miller, Welsh & Kratz

[57] ABSTRACT

A partition for segregating merchandise on perforated shelving includes an elongated planar body member with a flange extending along one elongated edge thereof which terminates at each end in tongues extending parallel to the elongated body. The partition is integrally molded from flexible yet stiff material such that the tongues may be deflected downward to insert the same in spaced perforations in the shelving where they bear against the underside of the shelving to secure the resilient partition in an upright position. Alternatively, the tongues may extend from spaced projections extending from the elongated edge near the two ends of the partition and one of the projections may be provided with conventional undercut hooks for engaging the perforation while the resilient tongues on the projections at the opposite end of the partition secure it in an upright position.

1 Claim, 5 Drawing Figures

PARTITION WITH RESILIENT TONGUES FOR ENGAGING PERFORATED SHELVING

BACKGROUND OF THE INVENTION

1. Field of the Invention

This invention relates to partitions for segregating merchandise on shelving and more particularly to such partitions for use with perforated shelving.

2. Prior Art

A popular type of shelving now in use for displaying merchandise is perforated with a continuous pattern of circular, diamond or other shaped holes into which devices may be inserted to secure partitions or other devices used for segregating merchandise on the shelves. Glass partitions and now some plastic partitions are secured in an upright position on the perforated shelving by splicer units which are U-shaped brackets with a vertical slot which receives the end of the partition. The splicer units are connected to the perforated shelving by undercut projections inserted into the perforations and are secured in place by the wedging effect of the partitions tending to spread the splicer units at opposite ends of the partition apart. Some wire partitions are secured to perforated shelving by adapter plates welded to the bottom of the partition which give it needed lateral stability. Hooks depending from the plates in opposite directions parallel to the plane of the partition are locked into place in the shelving by spreading the hooks apart through pulling on the ends of the partition, inserting the hooks in spaced perforations and releasing the ends of the partition. Similarly, in the plastic partition disclosed in U.S. Pat. No. 3,501,019 an integral S-shaped resilient mounting for one hook permits the oppositely directed hooks to be spread apart to insert them in the perforations and then pulls them together to lock the partition in an upright position. In another type of wire merchandise separator, a resilient U-shaped portion of the wire rests on the perforated surface with adapter plates attached to the legs of the U. The two legs of the U are squeezed together to insert hooks extending from the adapter plates in opposite directions transverse to the legs into spaced perforations on the shelf and then released to lock the separator in place.

The merchandise separator of my commonly owned, concurrently filed application includes an elongated planar body member and a pair of spaced feet extending laterally from one elongated edge of the body member. The integrally molded partition is made of resilient yet stiff material such that the planar body member may be twisted about a longitudinal axis to insert first one and then the other of the feet into spaced perforations on the shelving. When the twist is released, the partition is held firmly on the shelving in an upright position.

The primary object of the present invention is to provide a merchandise separator which is simple in design and eliminates the need for separate adapters or splicers.

Another object is to provide such a device which is easily installed yet locks itself firmly in place. Yet another object is to provide such a device which is simple in design and can be easily and economically constructed.

SUMMARY OF THE INVENTION

In accordance with the invention, a shelf partition for use with perforated shelving comprises an elongated planar body member and a pair of support members spaced along one elongated edge of the elongated planar body member for securing the partition to the perforated shelving. At least one of the support members comprises a projection extending from the elongated edge substantially normal to the plane of the partition, and a resilient tongue extending from the projection in a direction parallel to the elongated edge. The tongue is insertable into a perforation in the shelving where it bears against the underside of the shelving to secure the partition in an upright position resting on the elongated edge.

Preferably, the support means includes a pair of projections extending normal to the plane of the partition in opposite directions from the elongated edge with a resilient tongue extending from each projection in a direction parallel to the elongated edge. Each of the tongues is insertable into a separate perforation in the shelving where it bears against the underside of the shelving to secure the partition in an upright position. Also preferably, the support members spaced along the elongated edge of the partition are of similar construction and the tongues of the two support members extend in opposite directions parallel to the elongated edge of the partition. In one embodiment of the invention, the projections of the two support members extend along the elongated edge to form a continuous flange extending from both sides of the elongated edge between the tongues of the two support members.

Alternatively, the second support member may include a hook for engaging a perforation in the shelving with the opening of the hook facing in a direction opposite the direction in which the resilient tongue of the first support member extends.

Considering the invention in another light, the partition may include an elongated planar body member with a flange extending along one elongated edge in both directions normal to the plane of the body member and a pair of fasteners at opposite ends of the flange for securing the partition to perforated shelving. At least one of the fasteners comprises a pair of resilient tongues extending from one end of the flange in a direction parallel to the elongated edge with one of the tongues in the pair on each side of the planar body member.

DESCRIPTION OF THE PREFERRED EMBODIMENTS

Figure 1:
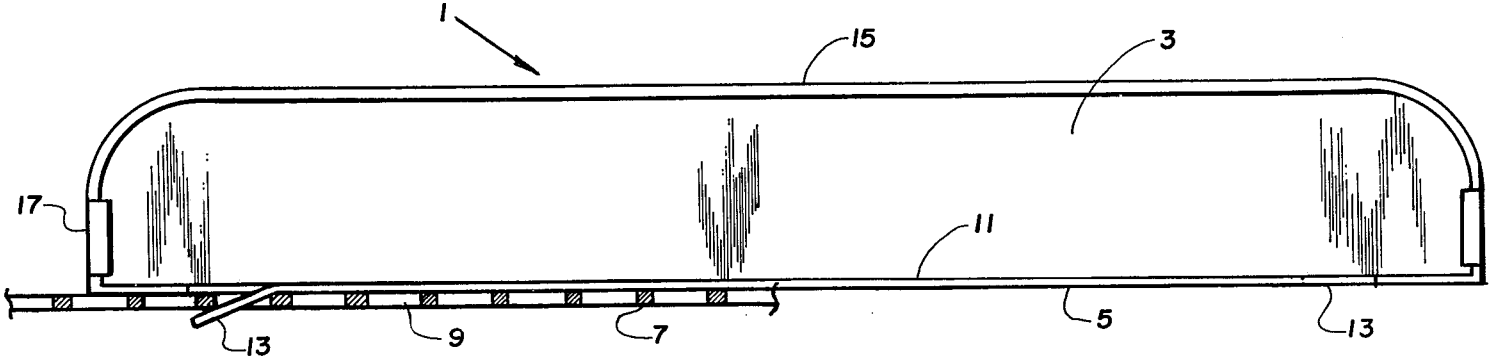
FIG. 1 is a side elevation view of a shelf partition according to one embodiment of the invention illustrating at the left end mounting of the partition on a section of perforated shelving.
Figure 2:
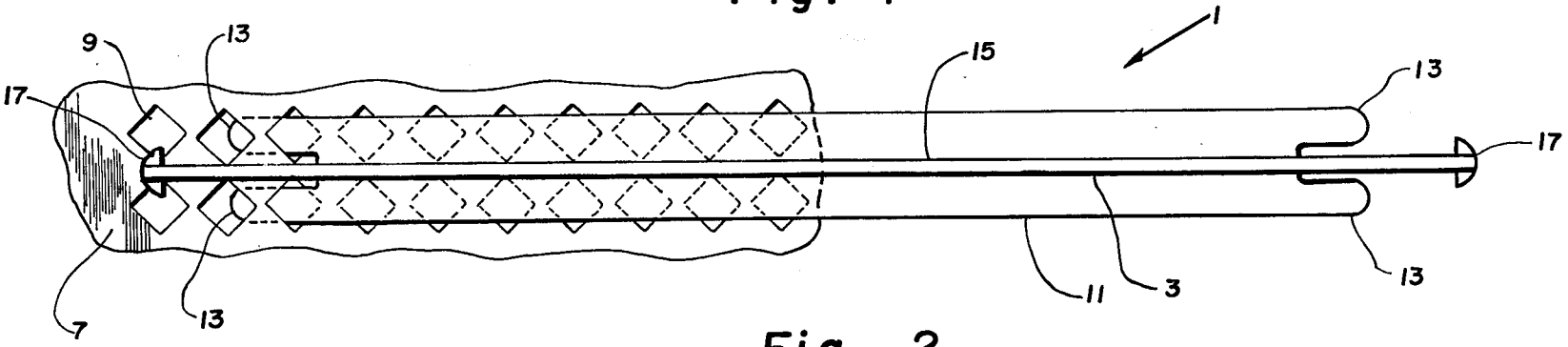
FIG. 2 is a plan view of the partition on FIG. 1.

FIGS. 1 and 2 illustrate a partition 1 having an elongated planar body member 3 which is mounted edgewise on an elongated edge 5 thereof on shelving 7 having a plurality of perforations 9 therein. While the perforations 9 of the shelving are illustrated as diamonds, they may be of any shape desired and could alternatively be circular or square, etc. Projecting in opposite directions from the elongated edge 5 normal to the plane of the elongated planar body member 3 is an integral flange 11 which provides the partition with a base resting on the perforated shelving. The flange 11 terminates short of the ends of the planar body member 3 in tongues 13 which extend parallel to the elongated edge 5.

The entire partition is molded as an integral unit from a flexible but stiff material such as polycarbonate, nylon, styrene, burate or any other material having these characteristics. To install the partition on the shelving, the resilient tongues 13 are deflected downward and inserted into spaced perforations 9 in the shelving 7 where they bear against the underside of the shelving to secure the partition in an upright position.

Figure 5:
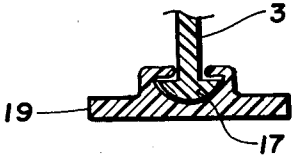
FIG. 5 is a plan view of one end of a partition according to the invention illustrating the mounting of a ticket holder thereon.

The elongated planar member 3 may be stiffened by molding a flange 15 along the top edge thereof. In addition, a T-shaped vertical flange 17 may be provided on one or both ends for mounting a ticket holder 19 as shown in FIG. 5.

Figure 3:
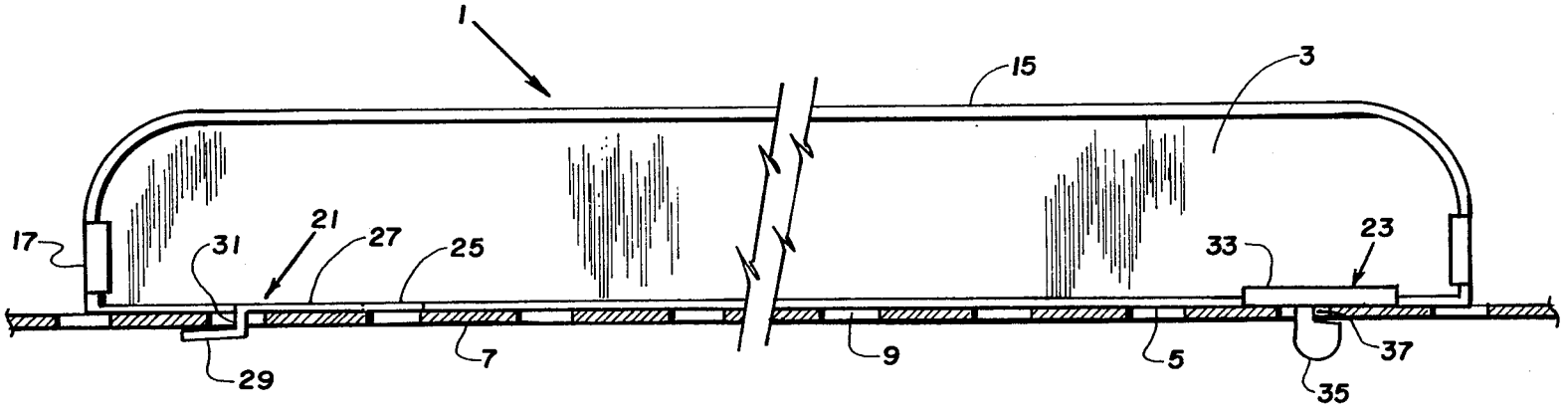
FIG. 3 is an elevation view of a shelf partition according to a second embodiment of the invention and illustrating mounted of the partition on perforated shelving.
Figure 4:
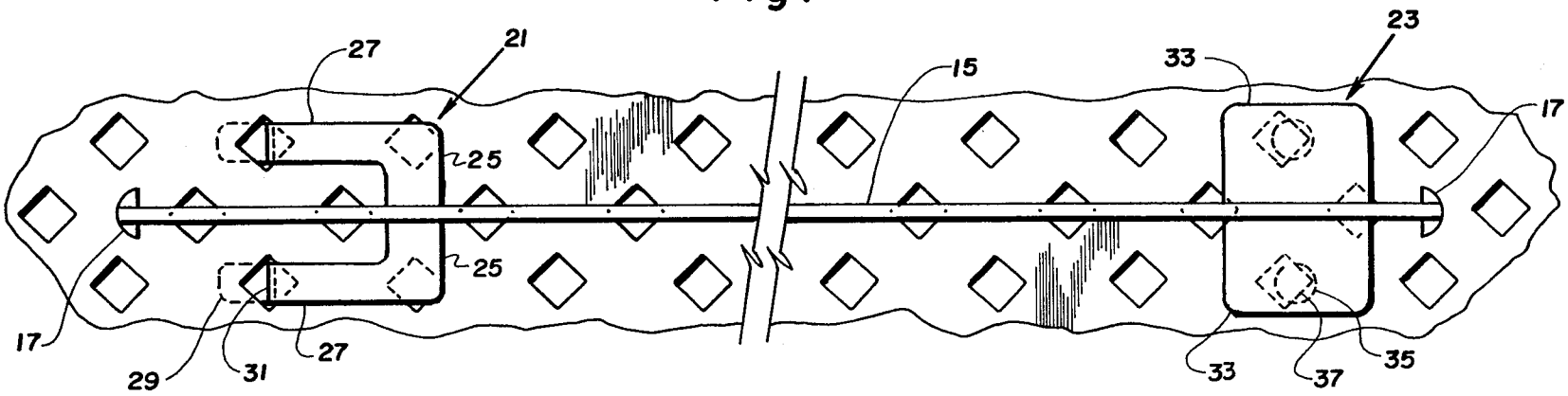
FIG. 4 is a plan view of the partition of FIG. 3.

FIGS. 3 and 4 illustrate another embodiment of the invention where like reference characters are used to identify features common with the embodiment illustrated in FIGS. 1 and 2. In this partition 1, support members 21 and 23 are spaced along the elongated edge 5 of the planar body member 3. The support member 21 includes projections 25 extending in opposite directions from the elongated edge 5 normal to the plane of planar body member 3. Tongues 27 extend from these projections 25 in a direction parallel to the elongated edge 5. The tongues 27 may be provided with a downward offset 29 to accommodate thicker shelving and to help lock the partition in place by providing a shoulder 31 which bears against the edge of the perforation 9.

The second support member 23 may be similar to support member 21 but with the tongues 27 extending in the opposite direction parallel to the elongated edge 5. Alternatively, as illustrated in FIGS. 3 and 4, the support member 23 may include projections 33 extending in opposite directions from the elongated edge 5 normal to the plane of the planar member 3 with conventional hooks 35 depending therefrom. The hooks 35 are undercut by a groove 37 which meshes with a corner of the diamond shaped perforations 9 in the shelving. To install this partition, the hooks 35 are inserted in perforations 9 in the shelving 7 and then the tongues 27 are deflected downward to pass through spaced perforations 9. When the resilient tongues 27 are released, the partition will be secured in the upright position illustrated in FIGS. 3 and 4.

Like the partition in FIGS. 1 and 2, the partition of FIGS. 3 and 4 is provided with an upper flange 15 for appearance and stiffening and also has a vertical flange 17 for receiving a ticket holder. While greatest stability is obtained by having projections 25 and 33 extending from both sides of the planar member 3 at both ends, it is to be understood that many variations are possible and that for instance only one projection on each end need be provided, but in such case they could extend from opposite sides of the planar member 3 or both on same side. It is also possible for the tongues 27 and the grooves 37 of the hooks 35 to face each other rather than facing in opposite directions as shown in FIGS. 3 and 4. In this case, the ends of the partitions may be bowed upward to assist in insertion of the tongues in the perforated shelving.

As will be evident to those skilled in the art, many variations all within the spirit of the invention can be made and therefore the invention is to be given the full breath and scope of the appended claims.

We claim:

1. A shelf partition for use with perforated shelving comprising an elongated planar body member, a flange extending along one elongated edge of said elongated planar body member in both directions normal to the plane thereof, and a pair of fasteners at opposite ends of said flange for securing said partition to the perforated shelving, each of said fasteners comprising a pair of resilient tongues extending from and integral with one end of said flange in a direction parallel to said elongated edge with one on each side of said elongated planar body member, said resilient tongues being insertable in separate perforations in said shelving where they bear against the underside of said shelving and firmly support said partition in an upright position on said shelving on said elongated edge.

* * * * *